US007740522B2

(12) United States Patent
Walker

(10) Patent No.: US 7,740,522 B2
(45) Date of Patent: Jun. 22, 2010

(54) KNIFE SHARPENER

(75) Inventor: Shane R. Walker, Cadott, WI (US)

(73) Assignee: National Presto Industries, Inc., Eau Claire, WI (US)

( * ) Notice: Subject to any disclaimer, the term of this patent is extended or adjusted under 35 U.S.C. 154(b) by 359 days.

(21) Appl. No.: 11/825,845

(22) Filed: Jul. 9, 2007

(65) Prior Publication Data

US 2009/0209177 A1 Aug. 20, 2009

(51) Int. Cl.
*B24B 1/00* (2006.01)

(52) U.S. Cl. ..... 451/45; 451/58; 451/65; 451/193; 451/234; 451/241; 451/349; 451/293; 451/451

(58) Field of Classification Search ..... 451/45, 451/54, 57, 58, 65, 182, 193, 231, 234, 241, 451/293, 349, 419, 420, 451
See application file for complete search history.

(56) References Cited

U.S. PATENT DOCUMENTS

| | | | | |
|---|---|---|---|---|
| 3,831,325 | A | 8/1974 | Joray et al. | |
| 3,956,856 | A | 5/1976 | Yonkers | |
| 3,993,116 | A | 11/1976 | Brewer | |
| 4,005,554 | A | 2/1977 | Campbell | |
| 4,085,547 | A | 4/1978 | Lawson et al. | |
| 4,807,399 | A | 2/1989 | Friel | |
| 4,915,709 | A | 4/1990 | Andrew et al. | |
| 5,245,791 | A | 9/1993 | Bigliano et al. | |
| 5,591,069 | A | 1/1997 | Wurthman | |
| 5,611,726 | A | 3/1997 | Friel et al. | |
| 5,620,359 | A | 4/1997 | Harrison et al. | |
| D409,891 | S | 5/1999 | Friel et al. | |
| 6,012,971 | A | 1/2000 | Friel, Sr. et al. | |
| 6,113,476 | A | 9/2000 | Friel, Sr. et al. | |
| 6,125,740 | A | 10/2000 | Hedrington et al. | |
| 6,267,652 | B1 * | 7/2001 | Friel et al. | 451/177 |
| 6,354,194 | B1 | 3/2002 | Hedrington et al. | |
| 6,881,137 | B2 * | 4/2005 | Friel, Sr. | 451/349 |
| 6,967,036 | B1 | 11/2005 | Hedrington et al. | |
| 6,969,299 | B1 | 11/2005 | Papetti | |
| 6,997,795 | B2 * | 2/2006 | Friel, Sr. | 451/555 |
| 7,104,874 | B1 | 9/2006 | Gussack et al. | |
| 7,134,935 | B1 | 11/2006 | Papetti | |
| 7,374,470 | B2 | 5/2008 | Fuchs | |
| 7,517,275 | B2 * | 4/2009 | Friel et al. | 451/198 |
| 2004/0198198 | A1 * | 10/2004 | Friel et al. | 451/198 |
| 2007/0026771 | A1 | 2/2007 | Harden et al. | |
| 2007/0281590 | A1 * | 12/2007 | Friel et al. | 451/45 |
| 2008/0176496 | A1 | 7/2008 | Tasi | |
| 2008/0261494 | A1 | 10/2008 | Friel et al. | |
| 2009/0075570 | A1 | 3/2009 | Levsen | |

FOREIGN PATENT DOCUMENTS

| | | |
|---|---|---|
| FR | 2827535 | 1/2003 |
| JP | 2160462 A | 6/1990 |

* cited by examiner

*Primary Examiner*—Eileen P. Morgan
(74) *Attorney, Agent, or Firm*—Patterson Thuente Christensen Pedersen, P.A.

(57) ABSTRACT

A motorized knife sharpener includes means of for sharpening heavy, medium, and fine blades at angles appropriate to the cutting edges of such blades.

5 Claims, 2 Drawing Sheets

KNIFE SHARPENER

FIELD OF THE INVENTION

The present invention relates to knife sharpeners. More particularly, the present invention relates to electrically powered knife sharpeners.

BACKGROUND OF THE INVENTION

Powered knife sharpeners are known in the industry. See for example U.S. Pat. No. 5,611,726, issued Mar. 18, 1997 to Friel et. al. Such powered knife sharpeners are typically optimized for a single type of blade. For best results, however, each type of blade must be presented to the rotating side face of a grinding wheel at an angle that is suitable for the existing type of cutting edge found on the blade. The angle of presentation changes significantly depending upon the type of blade, for example a cleaver or hunting knife must be presented at a significantly greater included angle with respect to the plane of the rotating side face of a grinding wheel than a paring knife or a fillet knife. The grinding angle for larger blades represented by the cleaver and hunting knife is significantly greater than the presentation angle of a paring knife or fillet knife.

As noted above, the powered knife sharpeners known in the art have a single presentation angle for presenting a blade edge to the grinding wheel. This single presentation angle limits the versatility of the known powered knife sharpeners. There is then a need in the industry for a single powered knife sharpener that could present varying types of blades to a grinding wheel at an angle that is appropriate to each of the various types of blades.

SUMMARY OF THE INVENTION

The knife sharpener of the present invention is designed to sharpen knifes of alloy, carbon, or stainless steel. It is designed to sharpen both kitchen knives and sporting knives. Accordingly, the knife sharpener of the present invention features three interchangeable blade guides. Each guide is labeled heavy, medium, or fine and has an illustration of the type of blade that the particular guide should be used for. There is a blade guide for each of the following blade types:

- Heavy blades—for sharpening hunting knives and cleavers.
- Medium blades—for sharpening regular kitchen and chef's knives.
- Fine blades—for sharpening fillet, paring knives and other light blades.

Each blade guide has three pairs of sharpening slots each corresponding to a sharpening stage. The sharpening stages are coarse grinding (stage 1) medium grinding (stage 2), and honing (stage 3). The stages are identified with a number (1, 2, or 3) behind each pair of slots.

The blade guides of the present invention are readily interchangeable so that a single powered knife sharpener is capable of sharpening a variety of different types of blade at angles appropriate to each of the particular blades simply by changing the interchangeable blade guides. Accordingly, the blade guides are designed to be readily interchangeable. In this manner, the knife sharpener of the present of invention substantially meets the aforementioned needs of the industry.

DETAILED DESCRIPTION OF THE DRAWINGS

Figure 1:
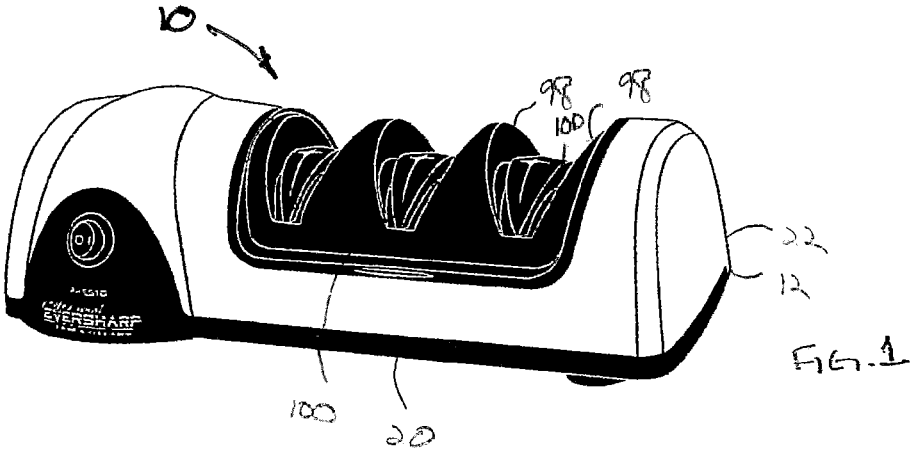
FIG. 1 is a perspective view of a knife sharpener according to an embodiment of the present invention.
Figure 2:
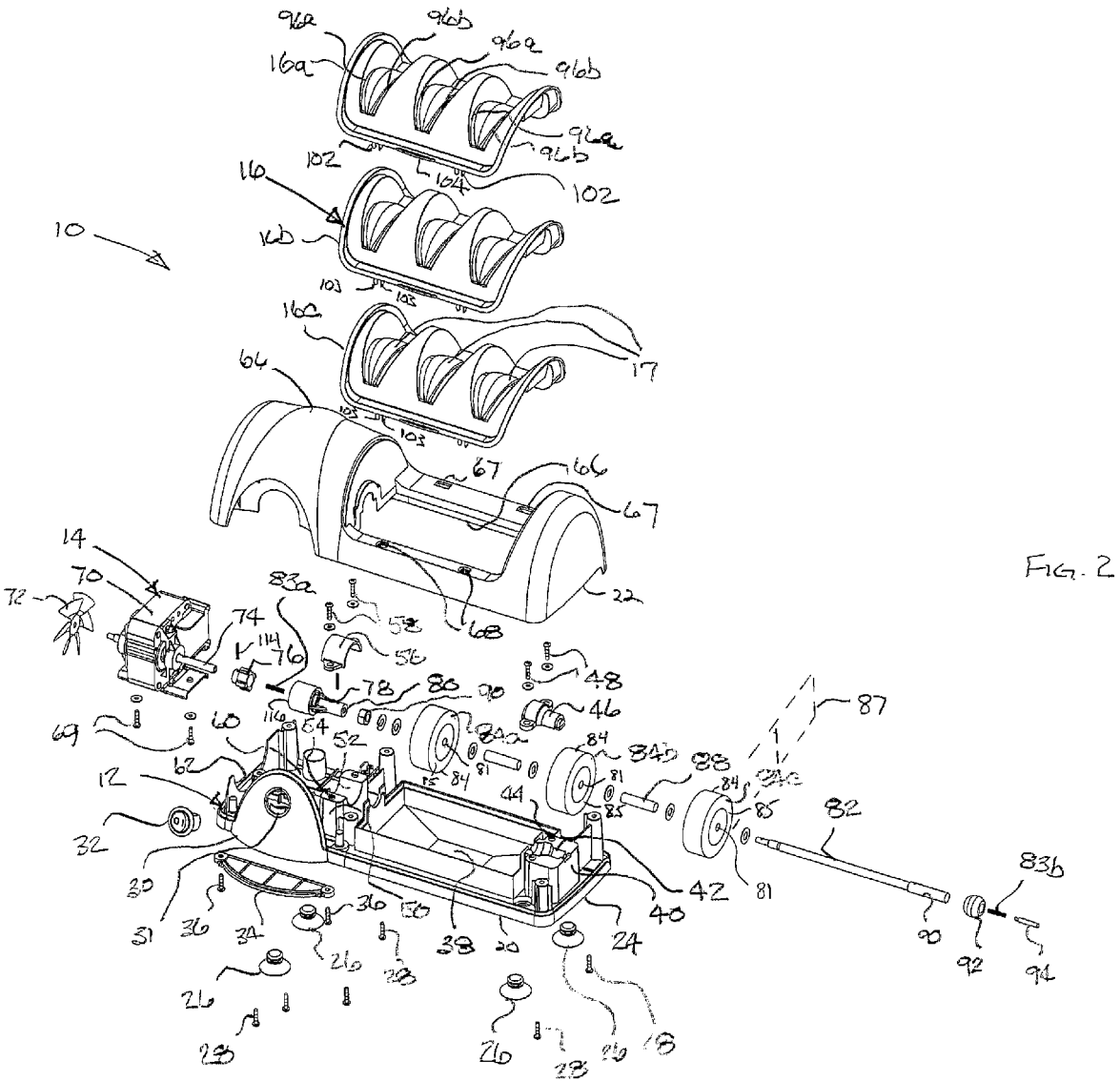
FIG. 2 is an exploded perspective view of the knife sharpener of FIG. 1.

The knife sharpener of the present invention is shown generally at 10 in FIGS. 1 and 2. Knife sharpener 10 includes three major subcomponents: Housing assembly 12, grinding assembly 14, and interchangeable blade guides 16. It is understood that while FIG. 2 depicts three interchangeable blade guides 16, the present invention need only have two interchangeable blade guides 16 and may have has many has four or more interchangeable blade guides 16 depending on the sharpening applications for which the knife sharpener 10 is intended to be used.

The first subcomponent of the knife sharpener 10 is the housing assembly 12, as depicted in FIGS. 1 and 2. The housing assembly 12 is comprised of a lower portion 20 and an upper portion 22.

The lower portion 20 of the housing assembly 12 includes a base 24. A plurality of feet 26 are affixed to the underside of the base 24 by beans of screws 28. Preferably, each of the feet 26 comprises a downward directed section cup for selective adhering to the surface supporting the knife sharpened 10.

A curved front cover 30 is affixable to the lower portion 20. The cover 30 has an opening 31 defined therein for receiving a power switch 32. A lower gap defined between the cover 30 and the lower portion 20 is closed with a cover base 34 held in place by screws 36.

A grind tray 38 is defined in the lower portion 20. The grind tray 38 captures filings from a sharpened blade and grit worn from a grinding disk. A bearing post is formed at either end of the grind tray 38. The bearing post 40 is defined at the distal end of the grind tray 38. The bearing post 40 includes a bearing receiver 42 defined therein. A pair of bores 44 flank the bearing receiver 42. A bearing cover 46 may be lowered into place over the bearing receiver 42 to capture a bearing and is held in place by screws 48.

The bearing post 50 is formed at the proximal end of the grind tray 38. The bearing post 50 includes a bearing receiver 52 that is also flanked by a pair of bores 54. A bearing cover 56 can be lowered into place to capture a bearing and is held in place by a pair of screws 58 threaded into the respective bores 54.

A motor housing 60 is defined inward of the cover 30. The motor housing 60 includes a fan intake 62 defined in the side wall of the lower portion 20.

The upper portion 22 of the housing assembly 12 includes a motor housing cover 64 adjacent to a guide opening 66. Louvers 65 (see FIG. 8) defined in motor housing cover 64 provide the passage of cooling air through the motor housing 60. The guide opening 66 has a pair of hook receivers 67 defined proximate the rear margin of the guide opening 66. A pair of corresponding tab receivers 68 are defined proximate the forward margin of the guide opening 66.

The second subcomponent of the knife sharpener 10 is the grinding assembly 14. The grinding assembly 14 includes an electric motor 70. The electric motor 70 preferably has a fan 72 connected to a first end of the output shaft 74. The second end of the output shaft 74 is received within a coupler 76.

A bearing 78 has an axial bore 80 defined there through. The axle 82 is disposed within the axial bore 80 and the bearing 78 is fixedly coupled to the coupler 76. Accordingly, operation of the electric motor 70 acts to rotate the axle 82. The axle 82 is axially shiftable for improved sharpening of a blade responsive to pressure exerted by a blade on. The axle 82 is biased in a center disposition by means of springs 83*a, b*, springs 83*a, b* being disposed proximate the respective proximal and distal ends of the axle 82. Pressure exerted by a blade on a side of a grinding disc 84 acts against a bias exerted by a respective spring 83*a, b* and, overcoming the bias acts to shift the axle 82 axially.

Referring to FIG. 2, a plurality of grinding disks 84 each have an axial bore 81 defined therein. The grinding disks 84 are fixedly coupled to the axle 82 by passing the axle 82 through the respective axial bore 81. The grinding disks 84 are spaced apart by means of spacers 88 and washers 86. It is understood that each of the grinding disks 84 is intended for a different grinding task. Accordingly, the grit of grinding disk 84A is typically more coarse than the grit of the grinding disk 84B and the grit of grinding disk of 84B is typically more coarse than the grit of the grinding disk 84C. The side margins 85 of the respective grinding discs 84 are the faces of the respective grinding discs 84 that perform the sharpening of the blade. The plane 87 of the side margins 85 of the respective grinding discs 84 is as noted in FIG. 2. A blade to be sharpened is presented to the respective side margins 85 of the respective grinding discs 84 at an exemplary included angle defined by the interaction of the blade and the blade guide 16 as discussed below.

The distal end the axle 82 has a region of expanded diameter on which a bearing 92 is disposed. The bearing 92 is kept in place by a bearing keeper 94.

Figure 3:
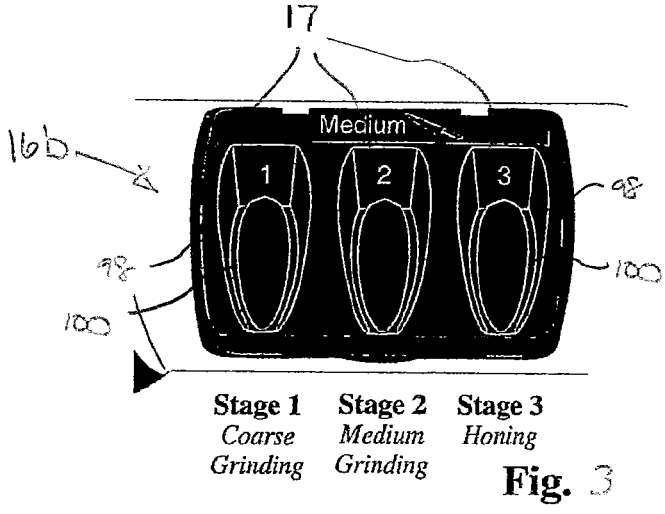
FIG. 3 is a top plan form view of an exemplary blade guide according to an embodiment of the present invention.

The third subcomponent of the knife sharpener 10 is the interchangeable blade guides 16, depicted in FIG. 2. In the depicted embodiment of the knife sharpener 10, there are three interchangeable blade guides 16A, 16B, and 16C. The blade guide 16A is adapted for sharpening large blades, such as sporting knives and cleavers. The blade guide 16B is for sharpening medium sized kitchen blades. The blade guide 16C is for sharpening fine blades, such as paring knives and fillet knives. FIG. 3 is a depiction of the bearing guide 16B and includes the annotation "medium" and a depiction of a typical medium-type blade. Likewise, the bearing guides 16A and 16C respectively depict heavy and fine blades.

Additionally, each of the blade guides 16 includes three stages 17, stages 1, 2, and 3 for sequentially performing coarse grinding, medium grinding, honing of the particular blade being sharpened, as noted in the depiction of FIGS. 1, 2 and 3. Accordingly, stage 1 presents the blade to be sharpened to the grinding disk 84A, stage 2 presents the blade to be sharpened to the grinding disk 84B, and stage 3 presents the blade to be sharpened to the grinding disk 84C. Each of the respective stages 17 of the blade guide 16 has a respective left and right slot 96A, 96B defined therein, as depicted in FIG. 2.

Referring to FIGS. 1 and 3, each of the slots 96A, 96B for each of the three stages 17 has an outside face 98 and an inside face 100. The outside face 98 of each slot 96 acts as a guide for presenting the blade to a respective side of the respective grinding disk 84 beneath the slot 96 at the desired angle. Accordingly, the side of the blade to be sharpened is rested on the outside face 98 and then brought into contact with the respective grinding disk 84. It should be noted that the angle of presentation of the blade to the grinding disk 84 is different for each of the three interchangeable guide blades 16A, B, C. The blade guide 16A, being the heavy guide 16 presents the blade at the greatest included angle 112 with respect to the side grinding surface 85 of the grinding disk 84. The blade guide 16B being the medium guide 16 tilts the blade to be sharpened to a more vertical disposition and presents the blade to be sharpened at a lesser angle with respect to the grinding surface 85 of the grinding disk 84. The blade guide 16C, which is adapted for sharpening fine blades, presents the blade to be sharpened at an angle that is even more nearly vertical and is the least angle of presentation 112 with respect to the grinding surface 85 of the grinding disk 84 of the three blades guides 16A, B, C. The angle of presentation for each of the three stages 17 of a particular blade guide 16 is substantially the same and angle of presentation left or right for a certain stage 17, 1, 2, or 3, is also substantially the same.

Referring to FIG. 2, each of the blade guides 16A, B, and C has a pair of depending tabs 102 located on the front margin of the respective guide 16. Each of the tabs 102 is comprised of two spaced apart engaging members 103. A protruding lip 104 is formed at the lower margin of the respective guide 16 and disposed between the two tabs 102.

At the rear margin of the respective guide 16 are two depending hooks (not depicted). The engaging portion of each hook is rearwardly directed to permit engagement of the hook with the underside margin of the respective hook receiver 67.

In assembly, the coupler 76 is affixed to the output shaft 74, preferably by means of a setscrew or a slotted spring pin 114, as depicted in FIG. 2. The grinding wheels 84A, B, C and associated hardware including the two bearings 78, 92 are assembled on the axle 82. This assembly is then coupled to the electric motor 70. Such coupling is affected by inserting the coupler 76 into a recess 116 defined within the side of the bearing 78 that faces the electric motor 70. Entire grinding assembly 14 may be lowered into the lower portion 20 of the housing assembly 12. The bearing 78 is rotatably borne in the bearing receiver 72 and the bearing 92 is rotatably borne in the receiver 42. The two covers 46, 56 may then be fixedly put in place by the respective bearings 78, 92. The upper portion 22 may then be fixedly engaged with the lower portion 20 to complete the assembly of the housing assembly 12.

For sharpening a particular blade, the user selects the appropriate interchangeable blade guide 16 depending on the category of blade to be sharpened, heavy, medium, or fine. To attach the selected blade guide 16 to the lower portion 20 of the housing assembly 12, the blade guide 16 is rotated away from the user so that the hooks can be inserted into the hook receivers 67. Once so engaged, the blade guide 16 is rotated toward the user, engaging the outward directed hook portion of the respective hooks in the hook receivers 67. Grasping the lip 104, the user presses downward in a rotating motion on the forward edge of the blade guide 16 causing the tabs 102 to engaged the tab receivers 68. A certain amount of pressure causes the two engaging portions 103 to compress inward slightly and then expand once inside the respective tab receiver 68, thereby engaging the blade guide 16 to the housing assembly 12.

Disengagement of the blade guide 16 from the housing assembly 12 is the opposite of the aforementioned engagement procedure and is commenced by the user grasping the lip 104 and applying upward and rearward rotating pressure to first disengage the tabs 102 and then disposing the hooks 106 with respect to the hook receivers 67 in such a disposition that the blade guide 16 may be lifted free of the housing assembly 12.

Referring to FIGS. 1, 2 and 3, the sharpening procedure for a blade is commenced by placing the blade in the left slot 96A of the selected stage 1, 2, or 3 to be used. The blade is rested against the outside face 98 on the cutting edge of the blade makes contact with the bottom of the slot 96A. The outside face 98 of each sharpening slot 96A acts as a guide to ensure that the blade is presented at the best presentation angle for sharpening with respect to the side grinding surface 85 of the respective grinding disk 84.

The blade 110 may be then drawn slowly through the left and right slots 96A, 96B approximately three times, alternating passes between the two slots 96A, B. The handle of the knife 110 can be raised slightly as the curved portion of the tip of the blade is presented to the grinding disk 84.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

The invention claimed is:

1. A knife sharpener, comprising:

a housing assembly enclosing a grinding assembly, the grinding assembly including a motor and a plurality of grinding disc operably coupled to the motor with a rotating axle assembly; and a plurality of interchangeable blade guides, each interchangeable blade guide being individually connectable to the housing assembly, wherein each interchangeable blade guide corresponds to a specified sharpening application, each interchangeable blade guide including individual grinding stages, each stage corresponding to one of the grinding discs, and wherein each grinding stage defines a presentation angle of a blade to a side grinding surface of the corresponding grinding disc wherein each stage of the blade guide presents a different angle fro the other stages.

2. The knife sharpener of claim 1, wherein each grinding stage is defined by a left blade slot and a right blade slot, and wherein each of the left and right blade slots includes an inside face and an outside face for establishing a presentation angle of the blade to the side grinding surface.

3. The knife sharpener of claim 1, said grinding stages including a coarse grinding stage, a medium grinding stage and a fine grinding stage, the coarse grinding stage, medium grinding stage and fine grinding stage facilitating presentation of the blade to the side grinding surface of the corresponding grinding disc at the proper presentation angle.

4. The knife sharpener of claim 1, wherein the plurality of interchangeable blade guides includes a kitchen blade guide and a sporting blade guide.

5. A method for sharpening a blade, comprising:

providing a knife sharpener including a grinding assembly having a plurality of driven grinding discs;

providing a plurality of individually interchangeable blade guides, each interchangeable blade guide including individual grinding stages, each stage corresponding to one of the grinding discs, and wherein each grinding stage defines a presentation angle of a blade to a side grinding surface of the corresponding grinding disc, wherein each stage of the blade guide presents a different angle fro the other stages;

selecting the appropriate blade guide based on the blade to be sharpened;

attaching the selected blade guide to the knife sharpener; and positioning the blade within the at least one grinding stage on the attached blade guide such that the blade is presented at a desired angle to a side grinding surface of the at least one grinding disc corresponding to the grinding stage.

* * * * *

UNITED STATES PATENT AND TRADEMARK OFFICE

CERTIFICATE OF CORRECTION

PATENT NO. : 7,740,522 B2
APPLICATION NO. : 11/825845
DATED : June 22, 2010
INVENTOR(S) : Walker It is certified that error appears in the above-identified patent and that said Letters Patent is hereby corrected as shown below:

On title page
Item 57, Abstract:
After "means" delete "of".

Column 1, Line 37:
Delete "knifes" and insert --knives--.

Column 1, Lines 52-53:
(stage 1), (stage 2), (stage 3) should not be bolded.

Column 2, Line 14:
Delete "has many has" and insert --as many as--.

Column 2, Line 34:
Delete "disk" and insert --disc--.

Column 2, Line 63:
Delete "there through" and insert --therethrough--.

Column 3, Lines 8, 9, 11, 13:
Delete "disks" and insert --discs--.

Column 3, Lines 15-17, 46-48, 55, 58, 59, 63, 67:
Delete "disk" and insert --disc--.

Column 4, Lines 4, 67:
Delete "disk" and insert --disc--.

Signed and Sealed this
Thirty-first Day of May, 2011

David J. Kappos

David J. Kappos
*Director of the United States Patent and Trademark Office*

Column 4, Line 46:
Delete “engaged” and insert --engage--.

Column 4, Line 62:
After “blade” insert --and--.

Column 5, Line 5:
Delete “disk” and insert --disc--.

Column 5, Line 18:
Delete “disc” and insert --discs--.

Column 5, Line 28:
After “disc” insert --,--.

Column 5, Line 29:
Delete “fro” and insert --from--.

Column 6, Line 21:
Delete “fro” and insert --from--.